United States Patent [19]

Casoli

[11] Patent Number: 4,739,781

[45] Date of Patent: Apr. 26, 1988

[54] COMPACT TOP LOADING DISHWASHER SUITABLE FOR FITTING INSIDE FURNITURE UNITS

[75] Inventor: Francesco Casoli, Fabriani, Italy

[73] Assignee: TOP S.r.l., Fabriano, Italy

[21] Appl. No.: 836,292

[22] Filed: Mar. 5, 1986

[30] Foreign Application Priority Data

Mar. 13, 1985 [IT] Italy ..... 19895 A/85

[51] Int. Cl.[4] ..... B08B 3/02

[52] U.S. Cl. ..... 134/115 R; 134/172; 68/3 R; 312/237; 312/228; 312/350

[58] Field of Search ..... 312/209, 237, 228, 350, 312/352; 220/400, 413; 68/3 R; 134/115, 56 D, 57 D, 58 D, 172; 4/630

[56] References Cited

U.S. PATENT DOCUMENTS

| | | | |
|---|---|---|---|
| 2,226,096 | 12/1940 | Halsey | 134/94 |
| 2,345,185 | 3/1944 | Edgar | 134/115 |
| 2,428,573 | 10/1947 | Loeb | 134/115 X |
| 2,570,021 | 10/1951 | Beach | 134/200 X |
| 3,207,167 | 9/1965 | Edstrom | 134/200 X |
| 3,358,702 | 12/1967 | Schaap | 134/115 X |
| 3,568,476 | 3/1971 | Seyler | 68/12 R |
| 3,570,271 | 3/1971 | Brown | 68/3 R |
| 4,016,608 | 4/1977 | Khan | 312/228 X |
| 4,254,788 | 3/1981 | Helwig, Jr. | 134/57 D |

*Primary Examiner*—Harvey C. Hornsby
*Assistant Examiner*—Frankie L. Stinson
*Attorney, Agent, or Firm*—Karl F. Ross; Herbert Dubno; Ronald Lianides

[57] ABSTRACT

The present invention concerns a compact top loading dishwasher suitable for fitting inside furniture units or the like, comprising a tub having an openable lid, an internal rotating washing member and one or more removable baskets for carrying articles located in the tub, the tub being supported on a metal base provided to house the mechanical and plumbing parts required for the supply and the operation of the dishwasher, it being possible to position the dishwasher, in a removable way, inside a kitchen unit, or the like, from which it can be removed for use at a different location.

7 Claims, 2 Drawing Sheets

COMPACT TOP LOADING DISHWASHER SUITABLE FOR FITTING INSIDE FURNITURE UNITS

Nowadays there is widespread use of high capacity front loading dishwashers which may be fitted inside kitchen units or the like, by making available a specific housing space.

Such dishwashers use a considerable amount of electricity and of water and can hardly be considered economical when used to wash a limited number of items in relation to the maximum washing capacity of the machine, such as is often the case for an ordinary family.

Moreover, there is often a need to use a dishwasher in other locations, such as holiday homes, camping trailers, boats and the like; in such instances a fairly compact and easily movable dishwasher could be very useful.

Both these and other problems, which will become clearer upon reading the specification, are solved by the compact top loading dishwasher, which is suitable for fitting inside kitchen units, which is the object of the present invention, and which comprises a tub having an openable lid, an internal rotating washing member and one or more removable baskets for carrying articles located in the tub, the tub being supported on a metal base provided to house the mechanical and plumbing parts required for the supply and the operation of the dishwasher, it being possible to position the dishwasher, in a removable way, inside a kitchen unit, or the like, from which it can be removed for use at a different location.

The base is equipped with telescopic runners provided for securing it to the unit and these allow the dishwasher to be pulled out from a position underneath the top surface of the unit to a position in which it is possible to open the lid in order to load the tub and to reach a panel carrying the dishwasher operating controls.

Said runners can be taken apart by separating a part integral with the unit and a part integral with the base, in order to remove and to transport the machine.

The dishwasher according to the invention comprises a selector switch allowing the machine to operate with reduced electrical consumption for installations having a limited supply of electricity.

The dishwasher can be incorporated in units without front panels. The lid can be removed when open; it is provided with a labyrinth of channels conveying air to the outside and taking the condensation back inside.

The control panel carries a knob for the manual operation of a tap for controlling the water supply.

The dishwasher according to this invention is suitably equipped with a dishwashing powder dispenser which can be fixed inside the tub.

Further details are given in the following description with reference to the attached drawings, in which.

Figure 1:
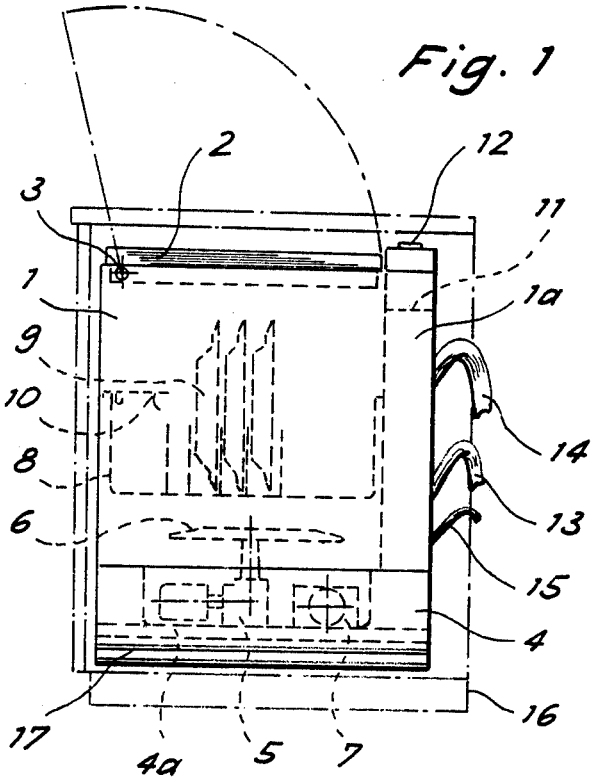
FIG. 1 is a general view of the dishwasher according to the invention.

As shown in FIG. 1, the dishwasher according to the invention comprises a tub 1, suitably formed in a single piece made of plastics material, having a lid 2 which opens by pivoting about a hinge 3.

The tub 1 is connected to a base 4, appropriately made of metal, to which the mechanical parts for the operation of the dishwasher are secured and these include a motor and pump assembly 5 capable of driving the rotatable washing part of the machine, which is provided with spraying holes, and of keeping it fed with pressurized water, a discharge water pump 7 and further devices for the supplies, water softener unit, safety and control units as required according to the standards for domestic electrical appliances.

The pumps 5 and 7 are suitably mounted on a transverse beam 4*a* of the base 4 so as to make it easy to gain access to the beam carrying the pumps from the bottom of the machine and remove it, by simply disconnecting the electrical and plumbing connections, to carry out maintenance of the pumps and, at the same time, ensuring that, when in operation, the pumps are rigidly supported upon the body of the machine.

In the tub 1 there is a removable basket 8 intended to carry crockery and utensils 9 and conveniently equipped with one or more adjustable shelves 10 enabling the maximum use to be made of the space inside the dishwasher.

Figure 4:
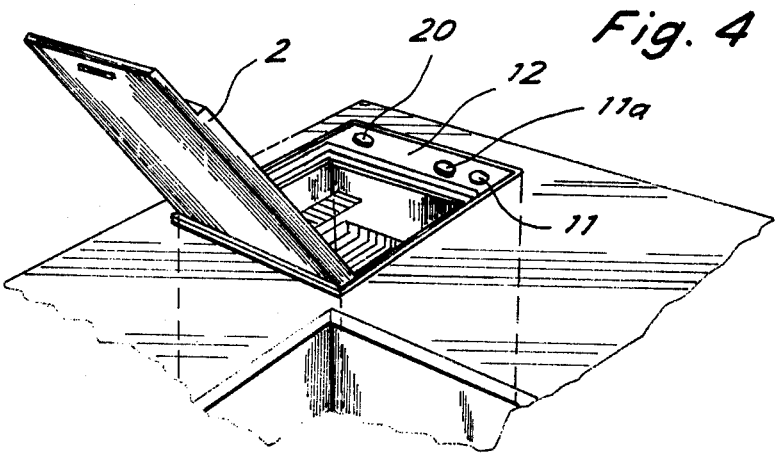
FIG. 4 shows a different installation which does not allow access from the front.
Figure 2:
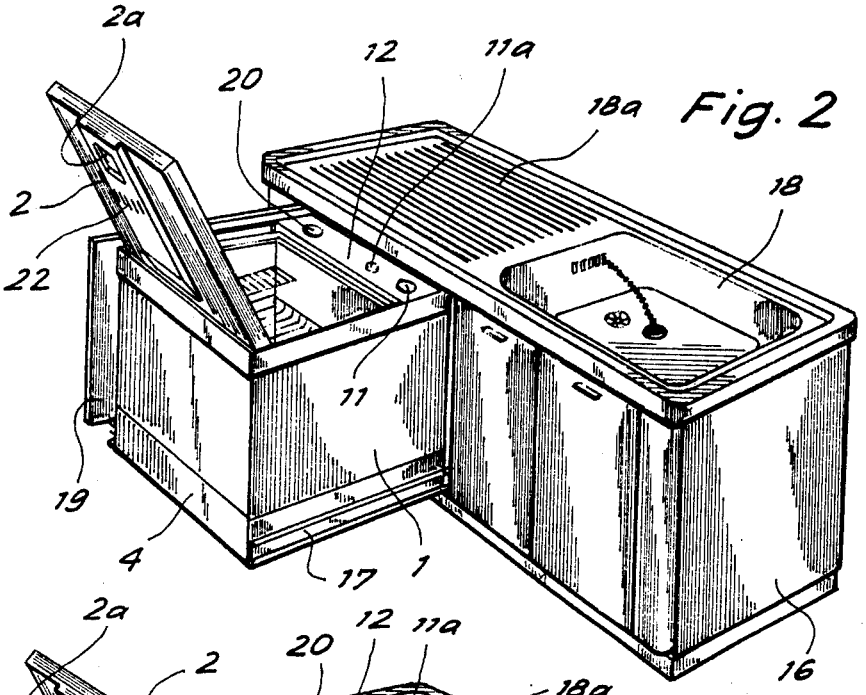
FIG. 2 is a view of the dishwasher according to the invention fitted under a unit comprising a sink.
Figure 3:
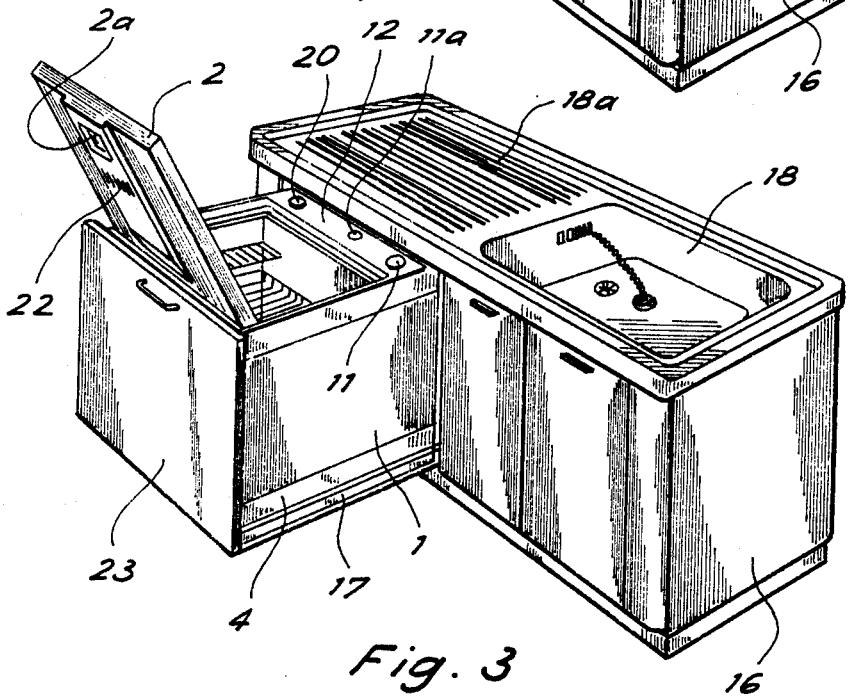
FIG. 3 shows an alternative embodiment of the unit of FIG. 2.

On the rear outer part 1*a* of tub 1, there is provided a timer 11 and other controls, such as a starting button 11*a* which is operated from an upper panel 12, and can be better seen in FIGS. 2, 3 and 4; the part 1*a* also carries the connections for the water supply pipe 13, the discharge pipe 14 and the electrical supply cable 15.

The lower part of the base 4 has a pair of telescopic runners, consisting of a fixed part suitable to be secured to a unit 16, the outline of which is shown in FIG. 1 by a dash-and-dot broken line, and a moving part 17 integral with the base 4.

As shown in FIG. 2, the dishwasher according to the invention can be fitted inside a kitchen unit 16 which includes a sink 18 and can be fitted under the flat draining board 18*a* of the sink unit by virtue of its compactness; in order to load the dishwasher, a door 19 is opened and the machine is removed from its housing by sliding it on runners 17, then operating a handle and a safety device 2*a* enabling the upper lid 2 to be lifted. In this way, the transfer of the crockery and utensils from the draining board 18*a* to the basket 8 inside tub 1 is quite easy, as is the access to the panel 12 for operating the control of the required washing programme. The panel 12 also carries a control knob 20, provided for easy operation of a tap able to cut off the water supply in pipe 13, if so required to avoid the automatic valves of the dishwasher from being under pressure when the machine is unused for long periods.

The lid 2 is suitably equipped with hinges 3, which can be separated when the lid is open, in order to enable the lid itself to be removed and the machine to be more easily loaded; the lid is suitably provided with air vents 22, which communicate with the inner part of the dishwasher by means of a labyrinth shaped pipe located inside the lid itself in which the stream condenses when it comes into contact with the cold outer face of the lid and falls back into the dishwasher, so that only air comes out of the vents 22.

In order to make it easy for the washing water to strike the crockery and utensils in the machine in a uniform way, the underneath part of the lid may be roughened or provided with a close relief surface to facilitate the formation of small drops and their dripping regularly from the whole surface of the lid.

FIG. 3 shows how it is possible to assembly the dishwasher by securing to it a front panel 23 homogeneous with the other panels and doors of the furniture units, so that no door has to be opened to pull out and load the dishwasher.

The telescopic runners on which the dishwasher is carried can also be taken apart by using simple loosening levers, the machine retaining only the fixed parts 17 which are secured to it thus making it possible for the dishwasher to be pulled out from the furniture unit and, after disconnecting its electrical and plumbing connections, to be transferred to a different location, i.e. a camping caravan, a boat, or the like, or to make maintenance easier.

When the dishwasher is used in places other than ordinary homes such as those mentioned above, the panel 12 or the lower part of the machine is provided with an electric switch for use in selecting an energy saving economy programme with longer washing times, in order to suit the amount of energy available.

FIG. 4 shows a different way of installing the dishwasher inside a unit which has no access from the front, for instance inside a kitchen corner unit, whose inner space is usually difficult to utilize; in this embodiment the upper surface of the lid is smooth and can be extended to cover the panel 12, so that the continuity of the work top is not interrupted when the dishwasher is not in use.

It is also possible for the dishwasher according to the invention to be incorporated in a single piece unit comprising a sink, in which case the lid of the dishwasher may act as draining board for the sink. Many different variations may be introduced, without departing from the scope of the invention in its general features.

What I claim is:

1. A top loading dishwasher for installation inside of a kitchen cabinet comprising:

a base;

a tub mounted on said base;

at least one removable basket in said tub for holding articles to be washed;

a rotating washing member in said tub;

an upwardly facing control panel mounted adjacent said tub;

an upwardly swingable lid mounted on pivots above said tub;

a transverse beam provided in said base for mounting mechanical and plumbing parts required for operation of said dishwasher, said beam being so dimensioned as to enable access to said mechanical and plumbing parts from the underside of said base; and an elongated runner mounted on either side of said base and coacting with a respective elongated runner provided in said cabinet on either side of said dishwasher, whereby said dishwasher can be pulled from said cabinet for access to said control panel and the lid opened for loading and unloading said tub, and means provided on respective coacting runners for the separation thereof, whereby said dishwasher can be removed from said cabinet, a pair of runners remaining on said base and the coacting runners remaining in said cabinet.

2. The dishwasher defined in claim 1 wherein said control panel can select a mode of electrical operation whereby said dishwasher can be used at a lower available energy level in a camper or boat.

3. The dishwasher defined in claim 1 wherein said cabinet has a countertop formed with a cutout in registration with said lid and said lid lies flush with the countertop to form a continuous surface therewith, whereby said lid can be opened without pulling said dishwasher from said cabinet.

4. The dishwasher defined in claim 1 wherein said lid is removable in an open position thereof.

5. The dishwasher defined in claim 1 wherein said lid is formed with a labyrinth of channels for conveying air from the interior of said dishwasher to the outside while retaining any moisture from the conveyed air within said dishwasher.

6. The dishwasher defined in claim 1 wherein said control panel operates a valve for shutting off the water supply to said dishwasher for relieving pressure on automatic valves contained therein.

7. The dishwasher defined in claim 1 wherein a detergent dispenser is provided in said lid.

* * * * *